US007100845B1

(12) United States Patent
Hsieh

(10) Patent No.: US 7,100,845 B1
(45) Date of Patent: Sep. 5, 2006

(54) SWITCH-EQUIPPED SPRINKLER

(76) Inventor: Elvis Hsieh, No. 31, 24th Road, Industry Park, Taichung City (TW)

( * ) Notice: Subject to any disclaimer, the term of this patent is extended or adjusted under 35 U.S.C. 154(b) by 0 days.

(21) Appl. No.: 11/255,934

(22) Filed: Oct. 24, 2005

(51) Int. Cl.
*B05B 1/02* (2006.01)
*B05B 1/14* (2006.01)
*B05B 1/18* (2006.01)

(52) U.S. Cl. ..... 239/447; 239/444; 239/448; 239/449; 239/525; 239/558; 239/559; 239/563; 239/582.1

(58) Field of Classification Search ..... 239/447, 239/444, 448, 449, 525, 558, 559, 563, 582.1, 239/436, 443, 446, 548, 560, 562, 565, 581.1, 239/DIG. 1
See application file for complete search history.

(56) References Cited

U.S. PATENT DOCUMENTS 4,165,837 A * 8/1979 Rundzaitis ..... 239/394
5,356,078 A * 10/1994 Bischoff ..... 239/447
6,230,989 B1 * 5/2001 Haverstraw et al. ..... 239/443
6,550,697 B1 * 4/2003 Lai ..... 239/446
6,641,057 B1 * 11/2003 Thomas et al. ..... 239/104
2004/0195381 A1 * 10/2004 Luettgen et al. ..... 239/463

* cited by examiner

*Primary Examiner*—Eric Keasel
*Assistant Examiner*—Darren Gorman
(74) *Attorney, Agent, or Firm*—Rosenberg, Klein & Lee

(57) ABSTRACT

A switch-equipped sprinkler including a main body, a rotary water-distributing switch and a color-changeable warning facial cap mounted in a facial cap of the sprinkler. The switch is mounted in the main body. The switch has an operating handle arranged between the facial cap and the handle of the sprinkler. In the case that the temperature of the water exceeds a set value, the color-changeable facial cap will warn a user. The switch is operable with single handle to control the path of the water flow and switch the figures of the sprinkled water as necessary.

4 Claims, 6 Drawing Sheets

SWITCH-EQUIPPED SPRINKLER

BACKGROUND OF THE INVENTION

The present invention is related to a switch-equipped sprinkler, and more particularly to a sprinkler with a rotary water-distributing switch.

In an existent sprinkler, a facial cap is rotatable for switching the figures of the sprinkled water. By means of rotating the facial cap, the path of water flow flowing through the water-distributing tray is controllable for switching the figures of the sprinkled water.

When switching the figures of the sprinkled water in shower, a user needs to respectively hold the main body of the sprinkler and the facial cap with both hands to rotate the facial cap for changing the figure of the discharged water. Therefore, the user can hardly conveniently and quickly change the figure of the water flow.

Moreover, the existent sprinkler cannot readily warn a user of the water temperature. In the case that the temperature of the water is too high, the user's safety may be threatened. Especially, the hot water coming from a water heater often has unstable temperature. Therefore, in shower, a user may get burnt due to too hot water even after the water temperature is set.

SUMMARY OF THE INVENTION

It is therefore a primary object of the present invention to provide a switch-equipped sprinkler which can be easily and conveniently operated.

It is a further object of the present invention to provide the above switch-equipped sprinkler which can readily respond to the temperature of the water.

It is still a further object of the present invention to provide the above switch-equipped sprinkler including a rotary water-distributing switch mounted in a main body and a color-changeable warning facial cap mounted in a facial cap of the sprinkler. The switch has an operating handle arranged between the facial cap and the handle of the sprinkler. In the case that the temperature of the water exceeds a set value, the color-changeable facial cap will warn a user and thus protect the user from getting burnt by too hot water. The switch is operable with single handle to control- the path of the water flow and switch the figures of the sprinkled water as necessary.

According to the above objects, the switch-equipped sprinkler of the present invention includes a rear cap, a water-distributing tray, a switch and a facial cap, wherein:

the rear cap has a hollow handle integrally connected with the rear cap, a first connecting section being disposed at a center of the rear cap, a first water outlet and a second water outlet being disposed under the first connecting section;

the water-distributing tray is mounted on front side of the rear cap, a tubular body being arranged on a circumference of the water-distributing tray, a third water outlet being formed on the tubular body, an upper water outlet being formed on the tubular body above the third water outlet, a second connecting section being disposed at a center of the water-distributing tray for fixedly connecting with the first connecting section of the rear cap;

the switch is mounted in the tubular body of the water-distributing tray and composed of an operating handle and a guide section, the guide section being formed with a fourth water outlet for communicating with the second water outlet and the third water outlet, the guide section being further formed with a fifth water outlet for communicating with the first water outlet, the fifth water outlet being positioned above the fourth water outlet approximately opposite to the fourth water outlet without communicating with the fourth water outlet, the guide section having a first stop section formed on back face of the fourth water outlet for blocking the second water outlet, the guide section further having a second stop section formed on back face of the fifth water outlet for blocking the first water outlet; and the facial cap is mounted on the water-distributing tray, a massaging cap being screwed in a center of the facial cap, the facial cap and the massaging cap being formed with multiple perforations through which the water is ejected The present invention can be best understood through the following description and accompanying drawings wherein:

DETAILED DESCRIPTION OF THE PREFERRED EMBODIMENTS

Figure 1:
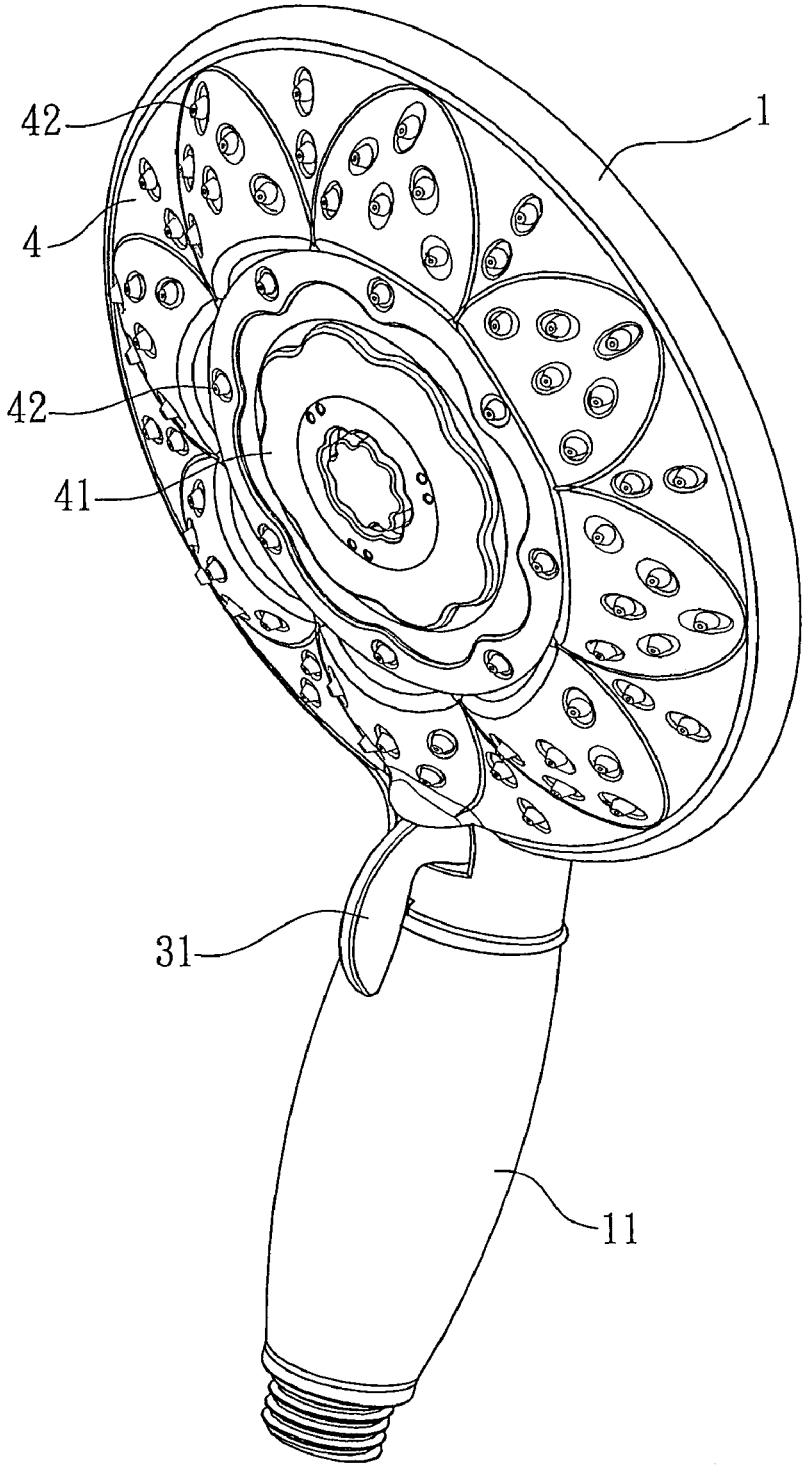
FIG. 1 is a perspective assembled view of the present invention.
Figure 2:
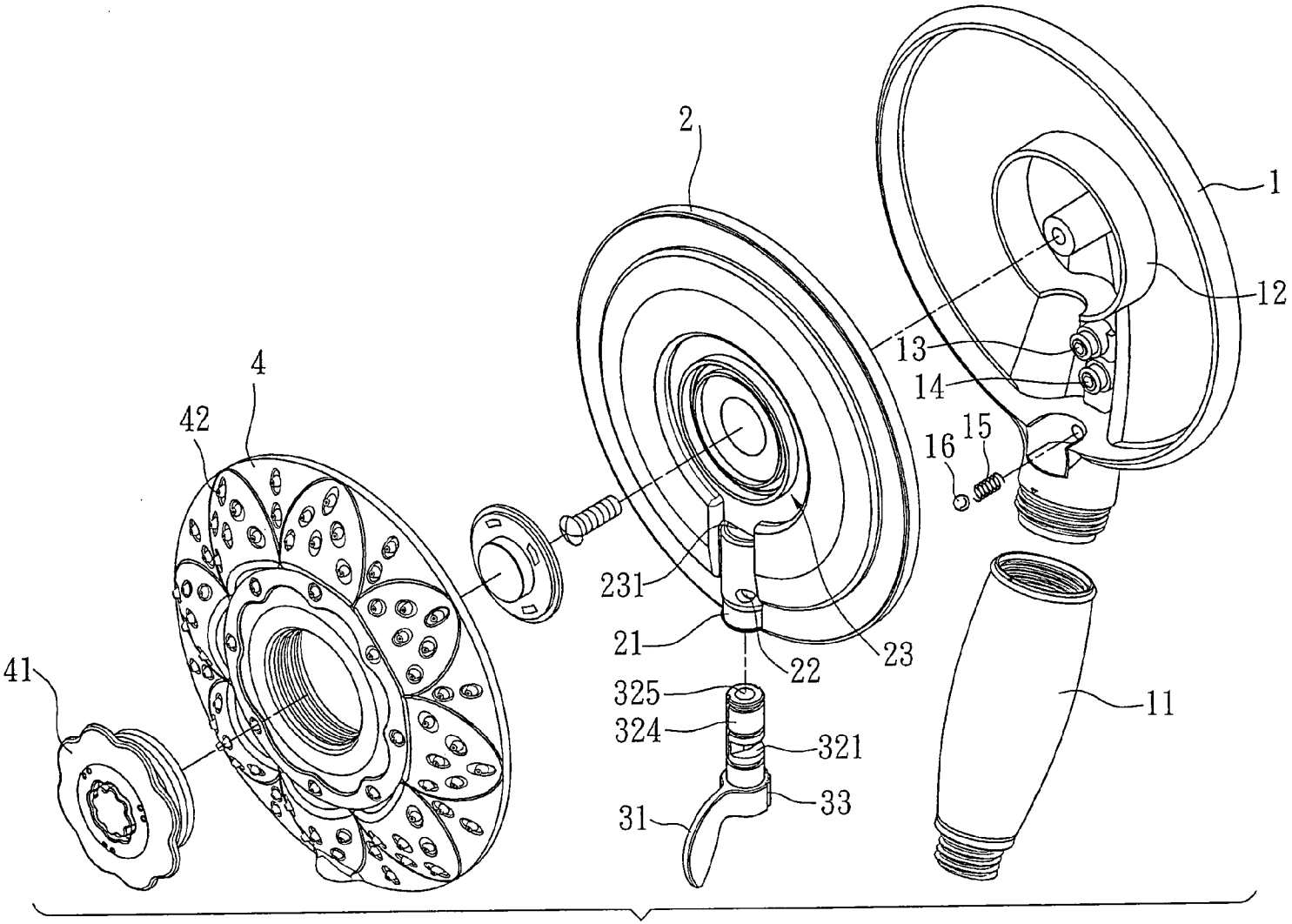
FIG. 2 is a perspective exploded view of the present invention.
Figure 3B:
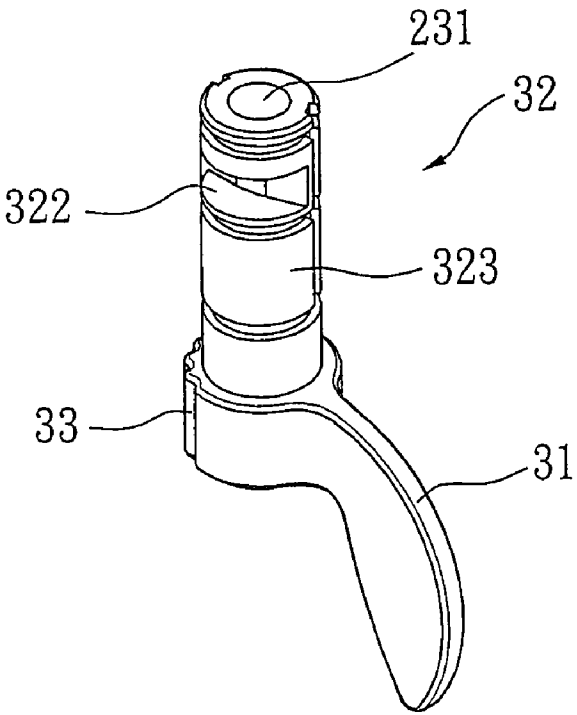
FIG. 3B is a perspective view of the switch of the present invention, seen in another direction.
Figure 3A:
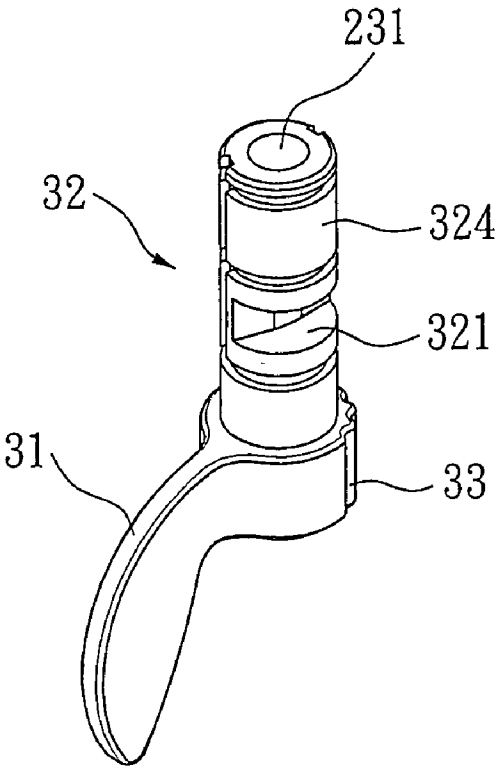
FIG. 3A is a perspective view of the switch of the present invention, seen in one direction.

Please refer to FIGS. 1 to 6. The switch-equipped sprinkler of the present invention includes a rear cap 1, a water-distributing tray 2, a switch 3 and a facial cap 4.

The rear cap 1 has a hollow handle 11 integrally connected with the rear cap 1. The water can flow through the handle 11 into the rear cap. A first connecting section 12 is disposed at a center of the rear cap 1. A first water outlet 13 and a second water outlet 14 are disposed under the first connecting section 12. A resilient member 15 and a stop member 16 are disposed in the rear cap 1 near the handle 11. In this embodiment, the resilient member 15 is a spring and the stop member 16 is a steel ball.

The water-distributing tray 2 is mounted on front side of the rear cap 1. A tubular body 21 is arranged on a circumference of the water-distributing tray 2. A third water outlet 22 is formed on the tubular body 21. An upper water outlet 231 is formed on the tubular body 21 above the third water outlet 22. A second connecting section 23 is disposed at a center of the water-distributing tray 2 for fixedly connecting with the first connecting section 12 of the rear cap 1.

The switch 3 is mounted in the tubular body 21 of the water-distributing tray 2 for controlling the figures of the water sprinkled from the sprinkler. In this embodiment, the switch 3 is a rotary switch composed of an operating handle 31 and a guide section 32. The guide section 32 is formed with a fourth water outlet 321 for communicating with the second water outlet 14 and the third water outlet 22. The guide section 32 is further formed with a fifth water outlet 322 for communicating with the first water outlet 13. The fifth water outlet 322 is positioned above the fourth water outlet 321 approximately opposite to the fourth water outlet 321. The fourth and fifth water outlets 321, 322 do not communicate with each other. The guide section 32 has a first stop section 323 formed on back face of the fourth water outlet 321 for blocking the second water outlet 14. The guide section 32 further has a second stop section 324 formed on back face of the fifth water outlet 322 for blocking the first water outlet 13. The fifth water outlet 322 communicates with a sixth water outlet 325.

A toothed section 33 is formed on backside of the switch 3. The resilient member 15 can push the stop member 16 to engage with the toothed section 33 and thus prevent the switch 3 from being rotated.

A massaging cap 41 is screwed in a center of the facial cap 4. The massaging cap 41 is made of a plastic material the color of which is thermally changeable.

The facial cap 4 and the massaging cap 41 are formed with multiple perforations 42 for sprinkling the water.

The facial cap 4 is mounted on the water-distributing tray 2. When the water flows from the water-distributing tray 2 to the facial cap 4 and the massaging cap 41, the water is ejected through the perforations 42. In addition, it can be known from the color of the massaging cap 41 whether the temperature of the water is higher than a set temperature such as 40° C.

Figure 4:
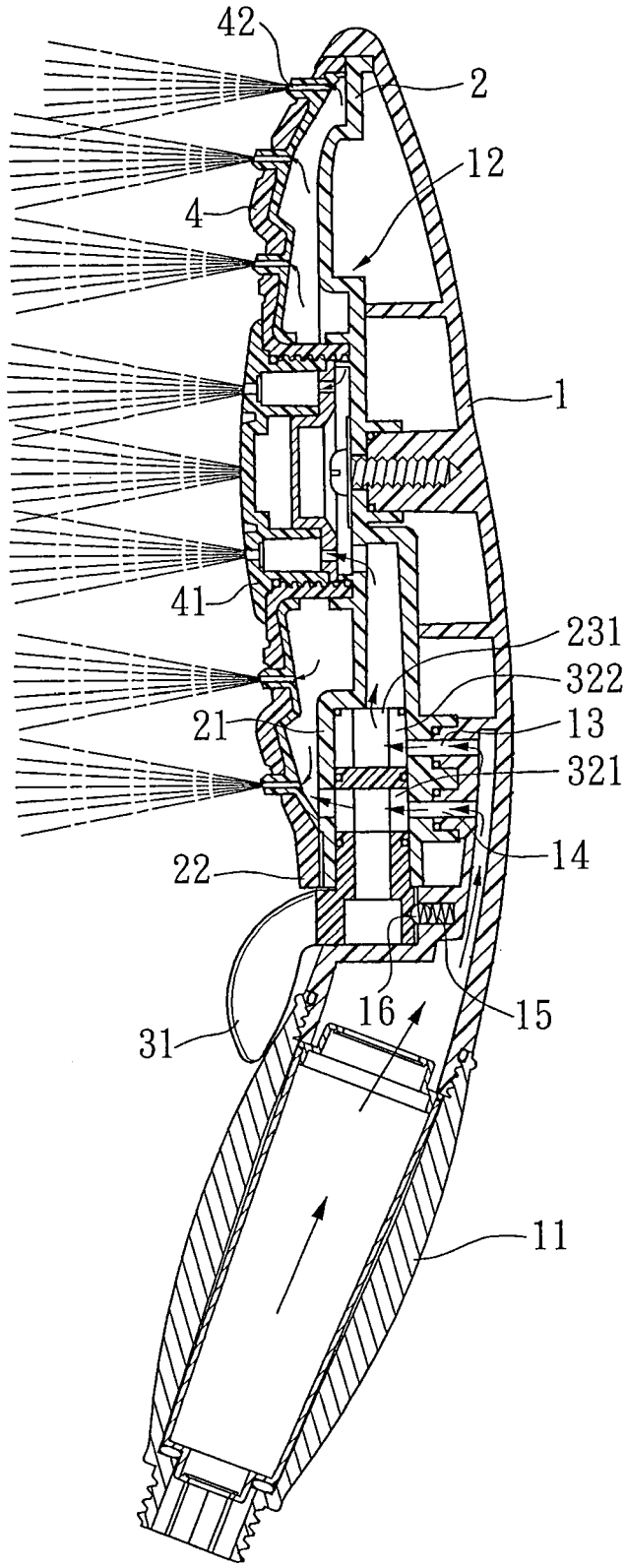
FIG. 4 is a sectional view showing a first figure of the water discharged from the present invention.

Referring to FIG. 4, when the operating handle 31 of the switch 2 is positioned in the middle, the second water outlet 14 of the rear cap 2 via the fourth water outlet 321 of the switch 3 communicates with the third water outlet 22 of the tubular body 21. Therefore, the water can be ejected from the perforations 42 of the facial cap 4. Also, the fifth water outlet 322 of the switch 3 communicates with the first water outlet 13 of the rear cap 1. The water can flow through the sixth water outlet 325 to the upper water outlet 231 and enter the massaging cap 41 at the center. Accordingly, the water will be ejected from the perforations 42 of both the facial cap 4 and the massaging cap 41 of the sprinkler.

Figure 5:
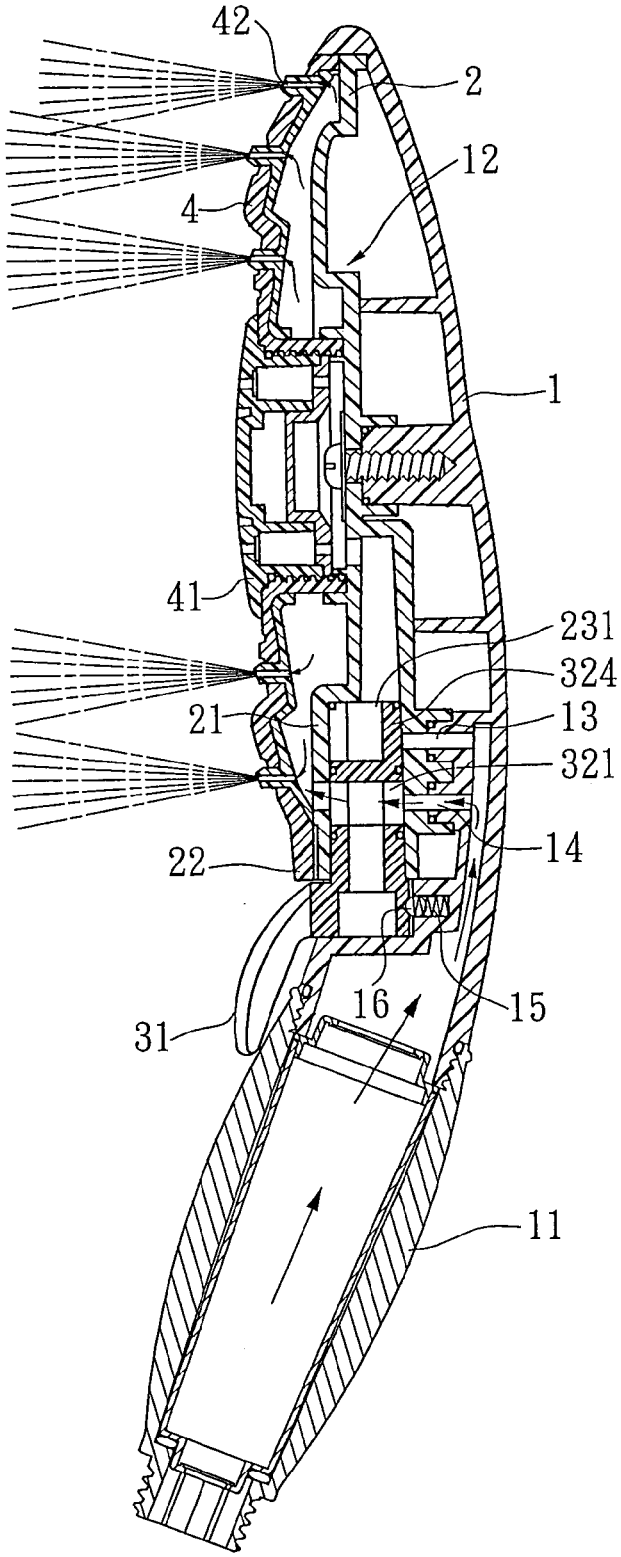
FIG. 5 is a sectional view showing a second figure of the water discharged from the present invention.

Referring to FIG. 5, when the operating handle 31 of the switch 3 is turned right, the second stop section 324 on backside of the fifth water outlet 322 will block the first water outlet 13. Under such circumstance, the path of communication between the fifth water outlet 322 of the switch 3 and the first water outlet 13 of the rear cap 1 is interrupted. Therefore, the water is stopped from discharging from the perforations of the center of the sprinkler. Accordingly, the water can only discharge from the perforations 42 of the facial cap 4.

Figure 6:
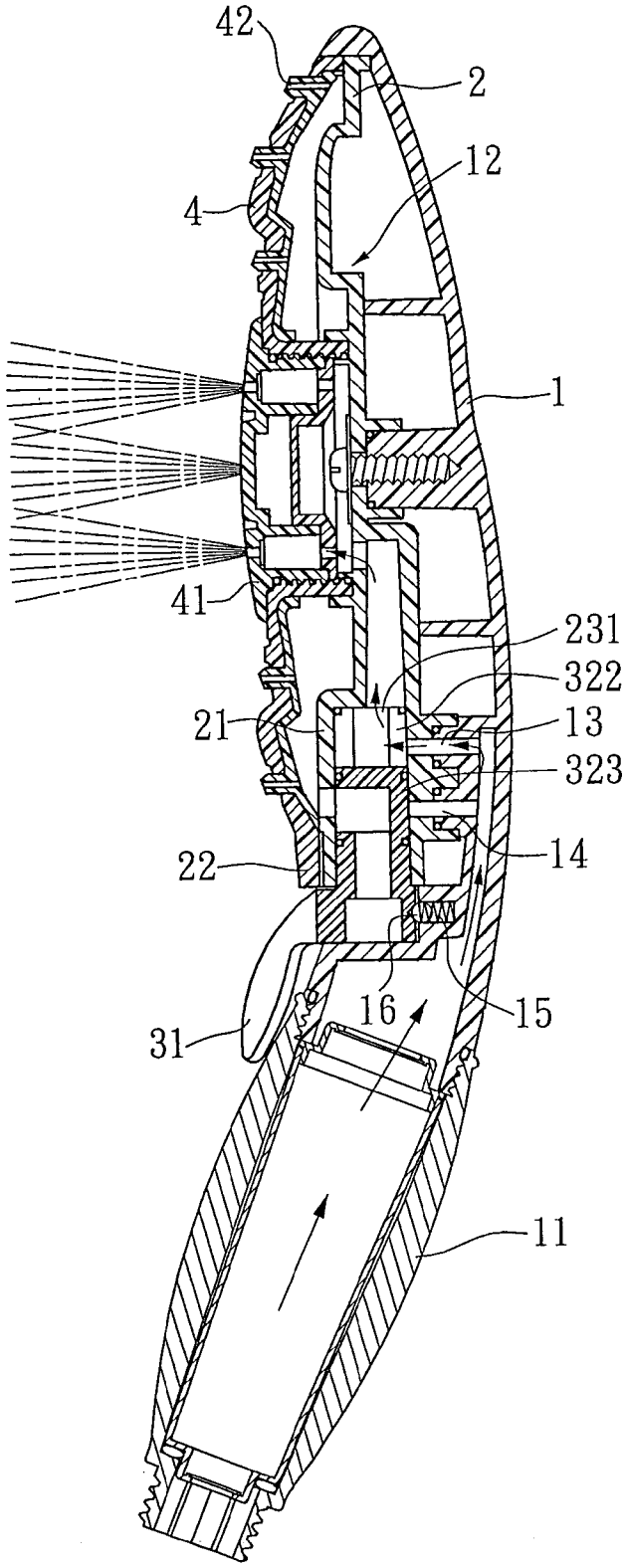
FIG. 6 is a sectional view showing a third figure of the water discharged from the present invention.

Referring to FIG. 6, when the operating handle 31 of the switch 3 is turned left, the first stop section 323 on backside of the fourth water outlet 321 will block the second water outlet 14. Under such circumstance, the path of communication between the fourth water outlet 321 of the switch 3 and the second water outlet 14 of the rear cap 1 and the third water outlet 22 of the tubular body 21 is interrupted. Therefore, the water is stopped from discharging from the perforations of the circumference of the sprinkler. Accordingly, the water can only discharge from the perforations 42 of the massaging cap 41.

The above embodiments are only used to illustrate the present invention, not intended to limit the scope thereof. Many modifications of the above embodiments can be made without departing from the spirit of the present invention.

What is claimed is:

1. A switch-equipped sprinkler comprising a rear cap, a water-distributing tray, a switch and a facial cap, wherein:

the rear cap has a hollow handle integrally connected with the rear cap, a first connecting section being disposed at a center of the rear cap, a first water outlet and a second water outlet being disposed under the first connecting section;

the water-distributing tray is mounted on a front side of the rear cap, a tubular body being arranged on a circumference of the water-distributing tray, a third water outlet being formed on the tubular body, an upper water outlet being formed on the tubular body above the third water outlet, a second connecting section being disposed at a center of the water-distributing tray for fixedly connecting with the first connecting section of the rear cap;

the switch is mounted in the tubular body of the water-distributing tray and composed of an operating handle and a guide section, the guide section being formed with a fourth water outlet for communicating with the second water outlet and the third water outlet, the guide section being further formed with a fifth water outlet for communicating with the first water outlet, the fifth water outlet being positioned above the fourth water outlet approximately opposite to the fourth water outlet without communicating with the fourth water outlet, the guide section having a first stop section formed on a back face of the fourth water outlet for blocking the second water outlet, the guide section further having a second stop section formed on a back face of the fifth water outlet for blocking the first water outlet; and the facial cap is mounted on the water-distributing tray, a massaging cap being screwed in a center of the facial cap, the facial cap and the massaging cap being formed with multiple perforations through which the water is ejected.

2. The switch-equipped sprinkler as claimed in claim 1, wherein a resilient member and a stop member are disposed in the rear cap near the handle, a toothed section being formed on a backside of the switch, whereby the resilient member can push the stop member to engage with the toothed section.

3. The switch-equipped sprinkler as claimed in claim 1, wherein the second water outlet of the rear cap via the fourth water outlet of the switch communicates with the third water outlet of the tubular body, whereby the water can be ejected from the perforations of the facial cap and the fifth water outlet of the switch communicates with the first water outlet of the rear cap, whereby the water can flow through a sixth water outlet to the upper water outlet and enter the perforations of the massaging cap at the center.

4. The switch-equipped sprinkler as claimed in claim 1, wherein the massaging cap is made of a plastic material the color of which is thermally changeable.

* * * * *